United States Patent [19]

Kusumegi et al.

[11] 4,447,734

[45] May 8, 1984

[54] RADIATION-SHIELDING TRANSPARENT MATERIAL AND METHOD OF PRODUCING THE SAME

[75] Inventors: Asao Kusumegi, Tsuchiura; Kenjiro Kondo, Niihari; Yoshiyuki Watase, Niihari; Yoshio Yoshimura, Niihari; Kozo Miyake, Kyoto, all of Japan

[73] Assignee: National Laboratory for High Energy Physics, Ibaragi, Japan

[21] Appl. No.: 304,885

[22] Filed: Sep. 23, 1981

[30] Foreign Application Priority Data

Nov. 13, 1980 [JP] Japan ..... 55-158800

[51] Int. Cl.[3] ..... G21F 1/00

[52] U.S. Cl. ..... 250/517.1; 250/515.1; 252/478; 376/288

[58] Field of Search ..... 252/478; 376/288; 250/515.1, 517.1

[56] References Cited

U.S. PATENT DOCUMENTS

| | | | |
|---|---|---|---|
| 2,594,970 | 4/1952 | Monk | 252/478 |
| 3,149,234 | 9/1964 | Hood et al. | 252/478 |
| 3,937,970 | 2/1979 | Bolles et al. | 250/515.1 |

*Primary Examiner*—Deborah L. Kyle
*Assistant Examiner*—Howard J. Locker
*Attorney, Agent, or Firm*—Parkhurst & Oliff

[57] ABSTRACT

Radiation-shielding transparent material comprising an aqueous solution of thallium formate with or without thallium malonate, the solution having a density of 2.5 to 4.3 g/cm$^3$, a radiation length of 3.8 to 1.9 cm, and a transmission of not less than 93% for light of 400 nm wavelength. The material is produced by deoxidizing thallium formate and dissolving the deoxidized thallium formate in deoxidized distilled water.

10 Claims, 7 Drawing Figures

Tℓ(HCO2)
(d=3.27g/cc)
SF-5
Tℓ(HCO2)+CH2(COOTℓ)2
(d=4.21g/cc)
Transmission T(%/cm)
100
80
60
40
20
0
300
350
400
450
500
550
Wavelength λ(nm)

RADIATION-SHIELDING TRANSPARENT MATERIAL AND METHOD OF PRODUCING THE SAME

BACKGROUND OF THE INVENTION

1. Field of the Invention

This invention relates to a radiation-shielding transparent material and a method of producing the same, which material shields radioactive rays such as neutron beams and γ-rays leaking from nuclear reactors, cyclotrons, or the like.

2. Description of the Prior Art

Neutron beams and γ-rays leaking from nuclear reactors, cyclotrons, or the like collide with surrounding substances and cause radiation which may be hazardous to people and apparatuses exposed thereto.

The leaking neutrons are in any form of high-speed neutrons, low-speed neutrons, and thermal neutrons. To moderate the high-speed neutrons, use of elements with small atomic numbers and compounds thereof has been known, such as hydrogen, helium, lithium, beryllium, boron, carbon, nitrogen, water, heavy water, and the like. Effective moderation of the high-speed neutrons is achieved by their collision with hydrogen (with an atomic number 1) having a small mass which is similar to that of neutrons, so that materials having a high concentration of hydrogen are very effective in moderating the high-speed neutrons. Water whose molecule has two hydrogen atoms and one oxygen atom is a least expensive yet very effective moderator for shielding the high-speed neutrons. More particularly, the high-speed neutrons are moderated by collision with water and converted into low-speed neutrons and thermal neutrons. However, the elements with a small atomic number and a small mass and compounds thereof are not effective in shielding γ-rays, and only elements with a large atomic number and compounds thereof are effective in shielding γ-rays, such as tungsten, lead, thallium, bismuth, tantalum, thorium, plutonium, and the like.

The low-speed neutrons and thermal neutrons are moderated by elements having a large cross section for neutron absorption, such as boron, cadmium, indium, and the like, so that the low-speed neutrons and thermal neutrons are converted by the moderation into γ-rays having an energy of about 0.42 MeV, whereby the overall energy of the leaking radiation is attenuated.

Conventionally, heavy concrete containing a moderator, such as iron, lead, barium, metal hydride, serpentine, boron, and the like has been used to shield nueclear reactors, cyclotrons, and the like. The heavy concrete is highly effective in absorbing γ-rays but not so effective in moderating neutrons which are leaking from the nuclear reactors, cyclotrons, or the like.

However, no materials capable of effectively moderating both γ-rays and neutrons without being damaged thereby have been found yet.

Lead glass has been used as a material for checking windows of nuclear reactors, cyclotrons, and the like, and the lead glass has been known as an effective radiation-shielding transparent material. Nevertheless, the transparent lead glass as the radition-shielding material has shortcomings in that the lead glass is very costly, i.e., one hundred million yen per several cubic meters thereof; that the lead glass is brittle when being machined, so that it has been difficult to machine a lead glass member into desired dimensions with high accuracy; and that the lead glass is coloured with the increase of lead content therein and the transparency thereof is reduced by the colouring. Thus, there have been no radiation-shielding transparent materials, except the lead glass, which are suitable for total absorption calorimeters for measuring the total energy of γ-rays and for shielding nuclear reactors and cyclotrons. The lack of radiation-shielding transparent materials overcoming the aforesaid shortcomings of the lead glass has seriously hampered the research and development of the aforesaid apparatuses of nuclear industries.

As regards radiation-shielding materials which are less costly than the lead glass, a solution of zinc bromide ($ZnBr_2$) has been known, but such a solution has shortcomings in that long-term chemical stability thereof is low and that the transparency thereof is gradually deteriorated. Accordingly, such solutions are seldom used now due to the aforesaid shortcomings.

Thus, there has been a pressing need for development of a radiation-shielding transparent material overcoming the shortcomings of the lead glass, so as to further expand the practical applications of radiation-related apparatus: for instance, shielding of nuclear reactors, instruments for measuring radiations such as γ-rays and neutrons, and medical apparatuses using x-rays and γ-rays.

SUMMARY OF THE INVENTION

The inventors noted the aforesaid points and carried out various studies on radiation-shielding transparent materials suitable for total absorption calorimeters, which materials are stable when being exposed to irradiation of any of γ-rays, x-rays, electron beams, and neutron beams without being damaged thereby. As a result, the inventors have found that a radiation-shielding transparent material can be produced by using a transparent heavy liquid prepared by deoxidizing an aqueous solution of organic thallium compound such as thallium formate and thallium malonate, which material can be used in any of the aforesaid apparatuses.

An object of the present invention is to provide a radiation shielding transparent material comprised of a heavy liquid prepared by deoxidizing either an aqueous solution of thallium formate or an aqueous solution of thallium formate and thallium malonate, which material has a density of 2.5 to 4.3 g/cm$^3$, a radiation length of 3.8 to 1.9 cm, a transmission of not less than 93%, preferably 95 to 99.5%, for light of 400 nm wavelength.

Another object of the present invention is to provide a method of producing a radiation-shielding transparent material, comprising steps of separately deoxidizing thallium formate and distilled water, and mixing the thus deoxidized thallium formate and deoxidized distilled water in a non-oxidizing atmosphere at a rate of 300 to 670 grams of thallium formate per 100 cubic centimeters of distilled water, so as to produce a heavy liquid having a density of 2.5 to 3.3 g/cm$^3$, a radiation length of 3.8 to 2.5 cm, and a transmission of not less than 93%, preferably 95 to 99.5%, for light of 400 nm wavelength.

A further object of the present invention is to provide a method of producing a radiation-shielding transparent material composed of heavy liquid, comprising steps of deoxidizing thallium formate, thallium malonate, and distilled water separately; and mixing the thus deoxidized thallium formate, thallium malonate, and distilled water at a rate of 300 to 800 grams of thallium formate and thallium malonate per 100 cubic centimeters of distilled water, so as to produce a heavy liquid having a density of 2.5 to 4.3 g/cm$^3$ (preferably 3.2 to 4.3 g/cm$^3$), a radiation length of 3.8 to 1.9 cm (preferably 3.3 to 2.5 cm), and a transmission of not less than 93% for light of 400 nm wavelength. The heavy liquid thus produced can be used as a radiation-shielding transparent material in lieu of the conventional lead glass. The radiation-shielding transparent liquid material of the present invention thus produced is featured in that the optical properties and radiation properties thereof are equivalent to or superior to those of the lead glass; that absorption of γ-rays and neutrons are both high; that the resistivity thereof against radiation damage is considerably higher than that of the lead glass; that cost thereof is noticeably lower than that of the lead glass; and that the freedom of shape and dimension thereof is high.

BRIEF DESCRIPTION OF THE DRAWINGS

For a better understanding of the invention, reference is made to the accompanying drawings, in which.

Figure 1:
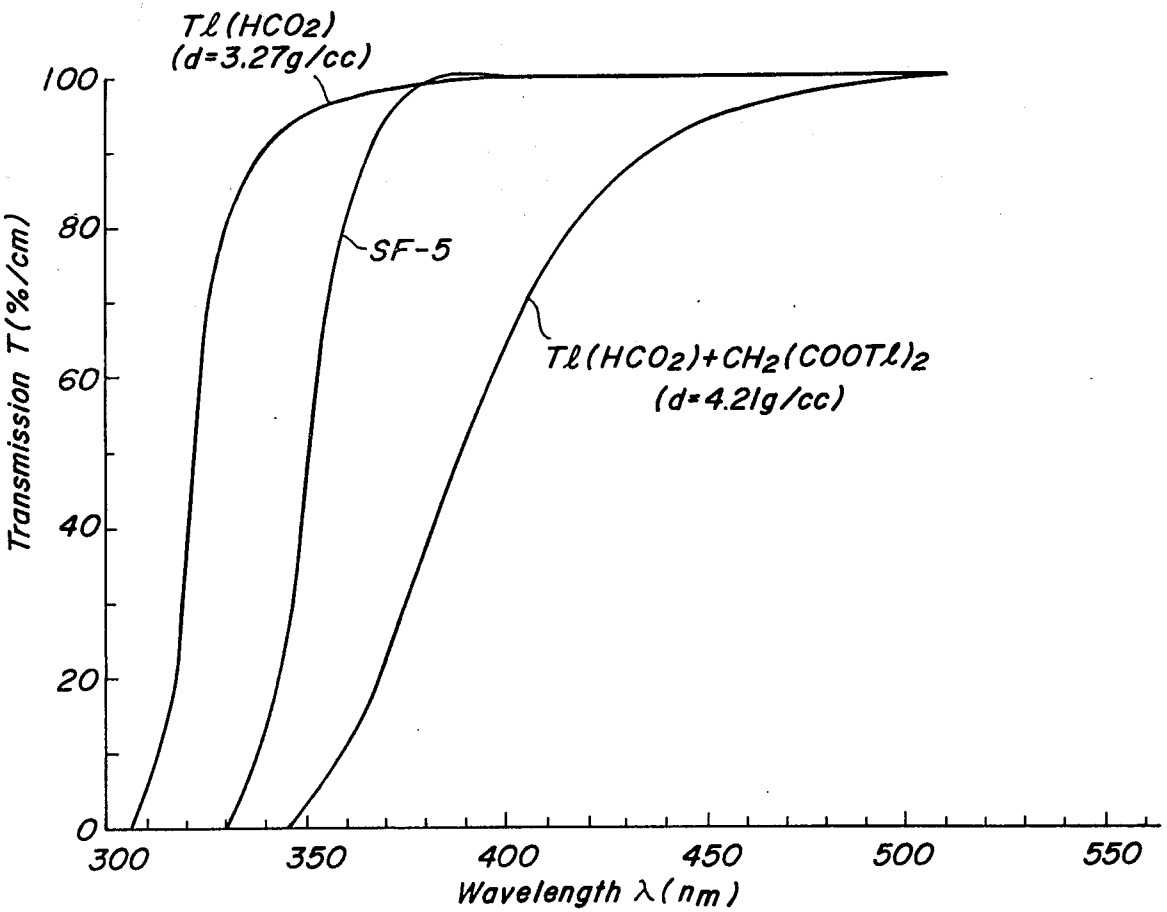
FIG. 1 is a graph showing the relationship between optical transmission and wavelength of light for three materials, i.e., thallium formate, SF-5 lead glass, and a mixed solution of thallium formate and thallium malonate.

Throughout different views of the drawings, 1 is a concrete shielding block, 2 is a stainless steel casing, 3 and 3' are shielding glass plates, 4 is a heavy liquid, 5 is a flange, 6 is a three-way sealing gasket, 7 and 8 are window-holder flanges, 9 designates bolts and nuts, 10 and 11 are valves, and 12 and 13 are pipes.

DESCRIPTION OF THE PREFERRED EMBODIMENTS

Total energy absorption calorimeters or counters are often used in experiments of high-energy physics to measure the total energy of charged particles or γ-rays. In such measurement of charged particles and γ-rays, the total energy absorption calorimeter must cause the total energy of the particles or γ-rays to be absorbed by the calorimeter and must detect the total energy thus absorbed without any loss. At final stages of the energy absorption, the energy of the particles and γ-rays is converted into light by ionization or Cherenkov radiation, which light is measured by converting it into electric signal pulses by a photomultiplier tube. Accordingly, both the total energy of radioactive rays being measured such as the particles or γ-rays and the absorbed amount of light are proportional to the magnitude of the electric signal pulses obtained by analog-digital conversion thereof. Based on such principles, the energy of the radioactive rays such as the charge particles or γ-rays can be determined.

To facilitate the aforesaid measurement, the energy absorbing material of the total absorption calorimeter is required to have the following characteristics; namely, (1) to have a high density, (2) to have a short radiation length, which should be short enough for absorbing the energy of the radioactive rays being measured such as the charged particles or γ-rays, and (3) to have a high transmission of light or a high transparency.

The following materials have been used heretofore as the energy absorbing material satisfying the aforesaid three characteristics; namely, (a) sodium iodide (NaI) crystal, (b) lead glass in the form of block, and (c) a sandwich of a heavy metal such as iron, lead, tungsten, and the like and scintillators (or liquid argon or the like).

The aforesaid material (a), i.e., sodium iodide (NaI) crystal, has a high energy resolution because of its ability to produce a large amount of light for a given energy, but the shape and dimension of the sodium iodide crystal are restricted due to the crystalline form thereof. Besides, the material (a) is expensive, namely, it costs abou six to ten times as much as lead glass. Hence, sodium iodide crystal is not suitable for practical applications. The aforesaid material (b), i.e., the lead glass, is most commonly used, but the shape and dimension of the material (b) are restricted due to the solid form thereof. Besides, the lead glass is fairly expensive. The sandwich of the aforesaid material (c) is the cheapest of the three, and various combinations of the heavy metals and scintillators are possible. However, the material (c) has shortcomings in that most of the energy absorbed is consumed in the heavy metal and only a small portion of the absorbed energy is available for the scintillators (or liquid argon or the like), so that it is liable to a large measuring error.

An example of the heavy liquid of thallium formate, which has been studied and developed by the inventors, has a density of 3.3 g/cm$^3$, a refractive index of 1.57, a radiation length of 2.5 cm, and a light transmission of not less than 93% for light of 400 nm wavelength, which transmission is comparable to that of SF-5 lead glass. The inventors tested this example of the heavy liquid in a total absorption calorimeter in a test beam channel from a proton synchrotron, and the tests proved that the heavy liquid of thallium formate was equivalent to or superior to the SF-5 lead glass. The resistivity of the heavy liquid of thallium formate against radiation damage proved to be far better than those of sodium iodide and the lead glass.

In addition to the aforesaid application to a total absorption counter (calorimeter) for measuring radioactive rays such as γ-rays, the heavy liquid of thallium formate can be applied to shielding of nuclear reactors, cyclotrons, x-ray, electron beams, or the like as excellent radiation-shielding transparent members.

It is noted that the radiation-shielding transparent members are often required in various tests, such as experiments using cyclotrons, tests of radiation chemistry, radiobiology, radiology, and the like. Although automatic remote monitoring is available by using a television camera and a television receiver, direct visual observation and monitoring are sometimes required to check the operation of nuclear reactors or the like.

The heavy liquid of thallium formate according to the present invention has an average density of 3.3 g/cm$^3$ and a radiation length of 2.5 cm, and when 300 to 670 grams of thallium formate is dissolved per 100 cubic centimeters of water, such aqueous solution has a density of 2.5 to 3.3 g/cm$^3$, a radiation length of 3.8 to 2.5 cm and a transmission of not less than 93% for light of 400 nm wavelength, which transmission is equivalent to or superior to that of the SF-5 lead glass. Besides, the resistance against radiation damage of the heavy liquid of the invention is clearly better than that of the lead glass. The heavy liquid of the invention was tested by EP1 beam of proton synchrotron and direct exposure to $3\times10^6$ rad of EP1 proton beam for one week did not cause any deterioration in the transmission of the thallium formate heavy liquid. On the other hand, when the SF-5 lead glass was exposed to $10^5$ rad irradiation from cobalt 60 ($Co^{60}$), the transmission at wavelength $\lambda=350$ nm of the lead glass was drastically reduced to 1% of the value before the irradiation, and the colour was turned brown, so that radiation damage was clearly recognized in this case.

The radiation-shielding ability of the heavy liquid of the invention is equivalent to or superior to that of the heavy concrete and twice or more of that of zinc bromide. The lead glass is mechanically weak and difficult to shape by machining, and once any crack is caused in the lead glass, repair thereof is usually very difficult. The heavy liquid of the invention proved to be stable in contact with stainless steel, aluminum, and Teflon (trademark of Du Pont) by tests for about four months and a half, so that the heavy liquid can be used to produce a checking window of radiation-shielding transparent type by placing it in a vessel made of such metal or Teflon. Thus, it has been confirmed by tests that the heavy liquid of thallium formate provides a much better radiation-shielding transparent member than those of the lead glass or zinc bromide solution.

A method of producing aqueous solutions of thallium formate will be now described.

Thallium formate is a white powdery crystal with a molecular weight of 249.5, and it is easily soluble in water to produce a heavy liquid having a density of about 2.5 to 3.3 g/cm$^3$, especially 3.27 g/cm$^3$, at 20° C. To use this heavy liquid as a radiation-shielding material, such as in a radiation counter, sufficiently high transmission of light is necessary in addition to the large density.

As regards the transmission of light, one problem is its deterioration caused by contact of the heavy liquid with air. Thallium (Tl) produces two kinds of ions, i.e., single valency thallium ion ($Tl^+$) and three-valency thallium ion ($Tl^{3+}$). However, the standard potential difference E° affecting the following equation (1) for thallium formate is fairly high, i.e., $E°=+1.25$ V, so that the three valency ions ($Tl^{3+}$) do not exist normally.

$$Tl^{3+}+2e^-\rightarrow Tl^+ \quad (1)$$

Thus, the contribution of the three-valency thallium ions ($Tl^{3+}$) to the colouring is negligible except under strongly acidic conditions.

It is noted that thallium formate completely dissociates in an aqueous solution, so that the aqueous solution is strongly alkaline due to the fact that formic acid is a weak acid.

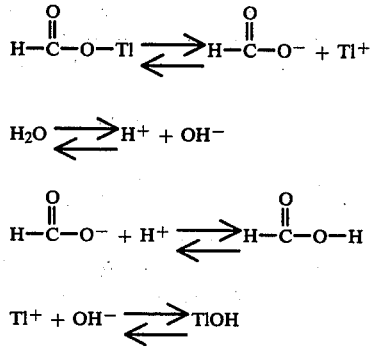

(2)

Here, the dissociation constant of formic acid is $1.8\times10^{-4}$.

Accordingly, when the heavy liquid of the invention is kept in contact with the air for a long period of time, it absorbs carbon dioxide gas from the air and produces thallium carbonate ($Tl_2CO_3$). Thallium carbonate has brown colour, so that it seriously deteriorates the transmission for light of 300 to 400 nm wavelength. On the other hand, if a heavy liquid contains thallium formate almost at the full solubility thereof and if a part of

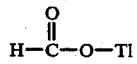

remains undissociated after the aforesaid dissociation of the equation (2), thallium oxide ($Tl_2O$) may be produced through chemical reaction with oxygen in the air. Similarly to thallium carbonate, thallium oxide has blackish brown colour and tends to seriously deteriorate the transmission.

In view of the aforesaid facts, to prepare thallium formate for producing the heavy liquid, it is important to suppress the heat generation in the chemical reaction between formic acid (HCOOH) and thallium hydroxide (TlOH). For instance, formic acid is dropped into a reaction flask while cooling it with ice water (0° C.). Preferably, the reaction is carried out in a glove box having an operation space filled with nitrogen gas, so as to minimize the contact with the air. Similar precautions are necessary in preparing an aqueous solution thereof. The aqueous solution thus prepared should be kept away from direct contact with air, or if contact with air is inevitable, the area of its contact with air should be kept to the minimum.

The aqueous solution produced in the aforesaid manner has a transmission of not less than 93% for light of 400 nm wavelength and can be used as transparent shielding members against radiation or the like. More particularly, thallium formate and distilled water are thoroughly deoxidized separately, and they are mixed in a non-oxidizing atmosphere at a rate of 300 to 670 grams of thallium formate per 100 cubic centimeters of distilled water. Whereby, a transparent heavy liquid is produced which has a density of 2.5 to 3.3 g/cm$^3$, a radiation length of 3.8 to 1.9 cm, and a transmission of not less than 93% for light of 400 nm (4,000 Å) wavelength.

Preparation of an aqueous solution containing both thallium formate and thallium malonate will be now described.

An aqueous solution containing thallium formate and thallium malonate at a rate of 1:1 has been used as a heavy liquid called Clerici liquid. However, Clerici liquid has not been used as radiation-shielding members or as counters (or calorimeters), because its transmission of light is low.

The inventors have tried to mix thallium formate and thallium malonate at ratios other than 1:1 with an intention of obtaining a heavy liquid with a density of 2.5 to 4.2 g/cm$^3$ and excellent transmission suitable for various applications. As a result, the inventors have succeeded in producing a transparent heavy liquid with a transmission of not less than 93% for light of 400 nm wavelength.

Although malonic acid has a dissociation constant of $1.4\times10^{-3}$ which is slightly larger than that of formic acid, the aqueous solution of thallium malonate is strongly alkaline due to the concentration of single-valency thallium ion ($Tl^+$). Accordingly, if it comes in contact with air immediately after being prepared, it will be coloured as in the case of the aqueous solution of thallium formate. When the concentration of the thallium salt is high, especially in the case of thallium malonate, partly non-dissociated ions may be produced, so that such high concentration liquid is susceptible to adverse effects by oxygen and carbon dioxide gas in the air. Accordingly, the aforesaid precautions for production of thallium formate solution are also applicable to the preparation of thallium malonate solution. During preparation of thallium malonate to be used in the production of the desired aqueous solution, it should be noted that thallium malonate is more susceptible to colouring due to heat generation or the like than in the case of thallium formate, so that due care must be paid to prevent the colouring.

As to aqueous solutions of thallium formate and thallium malonate, the stability of the aqueous solution increases with the increase of water content therein. The inventors found that a stable transmission of light for a fairly long period of time could be achieved at a density of about 4.0 g/cm$^3$. The reason for such stable transmission seems to be in that the water content in such stable solution is higher than that in an aqueous solution containing thallium formate and thallium malonate at full solubilities thereof, and thallium carbonate ($Tl_2CO_3$), thallium oxide ($Tl_2O$), and the like dissolve again in the water.

More particularly, while thallium formate is deoxidized, 10 to 90% of deoxidized thallium malonate is mixed therewith, and the mixture thus formed is deoxidized, and the deoxidized distilled water is added into the mixture being deoxidized at a rate of 300 to 800 grams of the mixture per 100 cubic centimeters of water. Whereby, a transparent heavy liquid having a density of 2.5 to 4.3 g/cm$^3$, a radiation length of 3.8 to 1.9 cm, and a transmission of not less than 93% for light of 400 nm wavelength is obtained.

Experiments on counters (calorimeters) and radiation-shielding window made by using the thallium formate heavy liquid according to the present invention will be described now, in comparison with similar experiments carried out by using the conventional lead glass.

Heretofore, most total absorption calorimeters use (a) sodium iodide (NaI), (b) lead glass, and (c) a sandwich of a heavy metal, such as iron, lead, tungsten, and the like, and either plastic or liquid scintillators.

Cryogenic liquids, such as liquid argon or liquid xenon, have also been used in combination with heavy metals; however, although these liquids are used as specific detectors, their uses are limited in size and in quantity, because they are too expensive. A large water Cherenkov radiator was used for cosmic-ray experiments and a Cherenkov counter of carbon tetrachloride ($CCl_4$) was studied with electrons of up to 217 MeV. However, those materials were used mainly for economy and for ease of handling rather than their characteristic features.

Among the calorimeters commonly used for high-energy physics experiments, the detectors of types (a) and (b) measure the total energies of electrons or protons either through ionization or Cherenkov radiation, whereas the detector of type (c) measures the total energy by sampling the ionization in the scintillators sandwiched with heavy metal absorbers. Consequently, the energy resolution is, in general, better in the detectors of types (a) and (b) than that of type (c); however, the latter has advantages of flexibilities in shape and size and of economy.

Apart from those used for cosmic-ray experiments, liquid Cherenkov counters were used as threshold detectors by adjusting the refractive index as a function of mixing ratio of two or more liquids. To the inventors' knowledge, little investigation has been done in the past by using heavy liquid as a total absorption calorimeter. Matano et al used an aqueous solution containing 30 to 35% of lead nitrate ($Pb(NO_3)_2$) in a counter with dimensions of $50\times50$ cm$^2$ surface area and 80 cm depth for investigations of air showers. The radiation length of this material was 11 to 13 cm corresponding to the depth of 6 to 7 cm of radiation lengths (r·1) in this case.

The inventors have thought about using a liquid material having a short radiation length and a reasonably high density as a Cherenkov or scintillation radiator. This can be attained by dissolving halogenated alkali or alkali earth metals in water. The inventors have selected zinc bromide ($ZnBr_2$) and zinc iodide ($ZnI_2$) as the representative materials. According to a standard handbook of chemistry, halogenized compounds like calcium iodide, barium bromide, mercuric bromide, stannic bromide, or cadmium borotungstate are also highly soluble in water. Among the complex salts, potassium mercuric iodide ($K_2(HgI_4)$) is much heavier than the others and thallium formate ($Tl(HCO_2)$), often used for mineralogical analyses such as heavy liquid ore dressing, is also highly soluble in water. These materials thus would be very attractive in view of their short radiation lengths and high densities. However, some of them are chemically unstable, less economical, or toxic; therefore, the inventors have selected the aforementioned two materials mostly from the practical point of view.

The physical and chemical properties of zinc bromide ($ZnBr_2$) and zinc iodide ($ZnI_2$) are quoted in Table 1 from a standard handbook together with the radiation and nuclear absorption lengths.

TABLE 1

| Material | Compound: Molecular weight (g/mol) | Compound: Density ($g/cm^3$) | Compound: Solubility (grams per 100 cc of water) | Aqueous solution of maximum concentration: Density ($g/cm^3$) | Aqueous solution of maximum concentration: Radiation length (cm) | Aqueous solution of maximum concentration: Absorption length (cm) |
|---|---|---|---|---|---|---|
| $ZnBr_2$ | 225.19 | 4.20 | 447 (20° C.) | 2.65 | 5.0 | 45 |
| | | | 675 (100° C.) | 2.97 | 4.3 | 40 |
| $ZnI_2$ | 319.18 | 4.74 | 432 (18° C.) | 2.80 | 3.8 | 47 |
| | | | 511 (100° C.) | 2.94 | 3.5 | 46 |

Tests by the inventors revealed that the heavy liquids made of zinc iodide ($ZnI_2$) and zinc bromide ($ZnBr_2$) were inexpensive but not chemically stable, so that such heavy liquids were not suitable for fulfilling the objects of the invention.

The inventors have searched for materials of heavy liquid having better properties than the aforesaid zinc iodide ($ZnI_2$) heavy liquid, so as to improve the characteristics of absorbing material of the total absorption calorimeters and the like. As a result, the inventors obtained a sample of an aqueous solution of thallium formate ($Tl(HCO_2)$). Subsequent tests of this material revealed that the thallium formate counter exhibited much superior characteristics of those of the zinc iodide counter although the zinc iodide counter was more economical than the former. The inventors were convinced that various features of the thallium formate counter were comparable to or even superior to those of the SF-5 lead glass Cherenkov counter, at least, in a short-term test.

An aqueous solution of thallium formate ($Tl(HCO_2)$) had a density d of 3.27 $g/cm^3$ and a refractive index n of 1.57. The results of transmission measurements as shown in FIG. 1 proved that the transmission of thallium formate is considerably larger than that of the SF-5 lead glass. FIG. 1 also shows a curve of the measured transmissions of the SF-5 lead glass and another curve of the measured transmissions of an aqueous solution of a mixture of thallium formate and thallium malonate ($CH_2(COOTl)_2$). The last mentioned aqueous solution had a density d of 4.21 $g/cm^3$ and a refractive index n of 1.69; however, the transmission thereof did not exceed that of a Cherenkov radiator made of the SF-5 lead glass at that stage, mainly due to the colouring caused by thallium malonate.

As a result of various experiments to remove the colouring of the aforesaid aqueous solution, the inventors have succeeded in obtaining a heavy liquid with a sufficiently high transmission from the aqueous solution by separately deoxidizing thallium formate and thallium malonate and then dissolving the two thallium compounds into deoxidized distilled water in a non-oxidizing atmosphere. The density of thallium formate is about 3.27 $g/cm^3$, and the mixing of thallium malonate with thallium formate results in a higher density of 4.21 $g/cm^3$. The heavy liquid with a large density is effective in shielding $\gamma$-rays, electron beams, and the like. Besides the aforesaid aqueous solution of the mixture of thallium formate and thallium malonate contains a large amount of water, so that it effectively moderate neutron beams.

Figure 2:
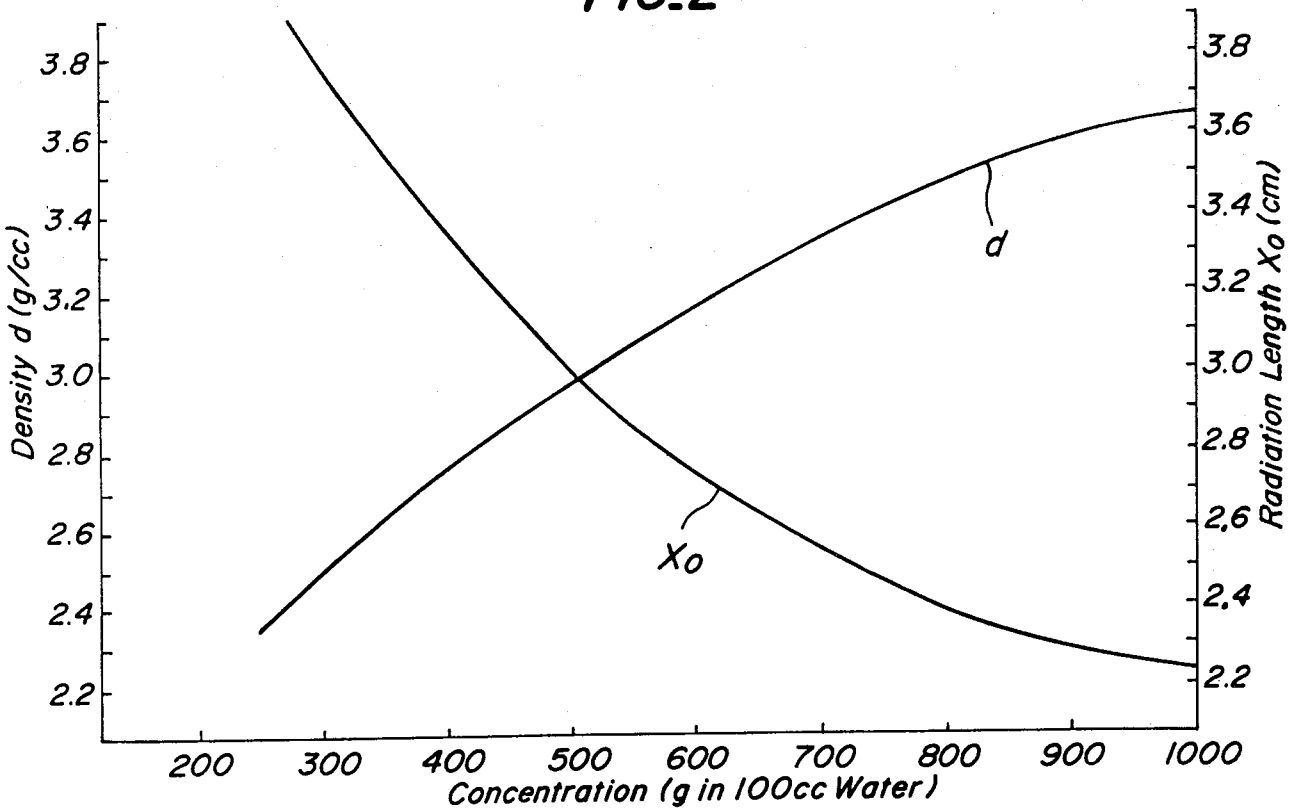
FIG. 2 is a graph showing variation of the density, and the radiation length of an aqueous solution of thallium formate as functions of the concentration thereof in terms of the number of grams of thallium formate in 100 cubic centimeters of water.

The density and the radiation length of the thallium formate solution were calculated by using the values listed in the standard handbook based on an assumption that the solvent was pure water. These values are shown in FIG. 2 as functions of the concentration in terms of the weight of thallium formate in 100 cc of distilled water. These values should be taken as a guide. The density d of 3.27 $g/cm^3$ corresponds to a solution consisting of about 670 grams of thallium formate ($Tl(HCO_2)$) dissolved in 100 cc of distilled water at an average room temperature of 25° C. The radiation length of the solution was estimated to be 2.57 cm and this is comparable to that of the SF-5 lead glass ($X_o$=2.54 cm). The procedure used to obtain the aqueous solution was similar to that for obtaining the zinc iodide solution described in the foregoing. It is a very important point to avoid direct contact of the aqueous solution with oxygen despite that this material is likely to be more stable against oxidation than the zinc iodide solution.

Figure 3:
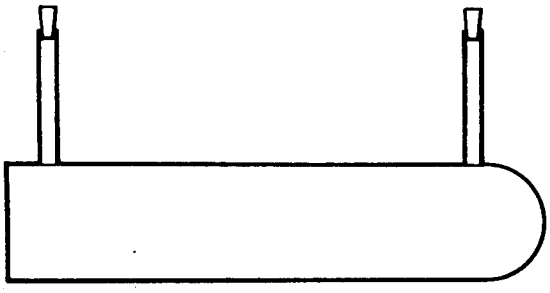
FIG. 3 is a schematic elevational view of a glass vessel used in experiments to form a thallium formate counter.

The solution thus obtained was transferred to a cylindrical glass vessel of 70 mm inner diameter and 400 mm length with one end flat and the other end hemispherical as shown in FIG. 3. Two cylinders of 7 mm diameter where formed at the top of the vessel to accommodate room for expansion of the fluid and to provide an inlet and an outlet for the solution. The shape of the glass vessel is shown in FIG. 3.

The vessel was wrapped with aluminum foil of 0.1 mm thickness and with adhesive tape (Scotch ® tape) for shielding against light. The flat end was coupled to a photomultiplier (with a manufacturer's identification number of HAMAMATSU R329) while using silicon oil to facilitate optical contact therebetween. For comparison, an SF-5 lead glass Cherenkov counter with dimensions of $6.5\times6.5\times29$ $cm^3$ was used. The same photomultiplier was used for both the SF-5 lead glass counter and the thallium formate counter under the same operating conditions.

Figure 5:
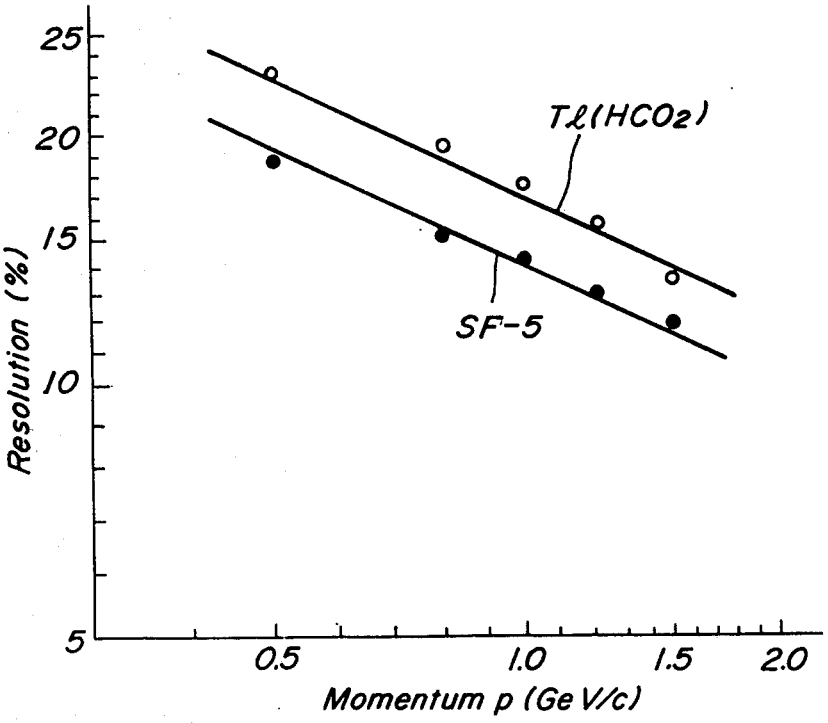
FIG. 5 is a log-log graph showing pulse-height resolution of signals from a counter using thallium formate with a density d of 3.27 g/cm$^3$ for different values of momentum of electrons, in comparison with corresponding values obtained by an SF-5 lead glass counter.
Figure 4:
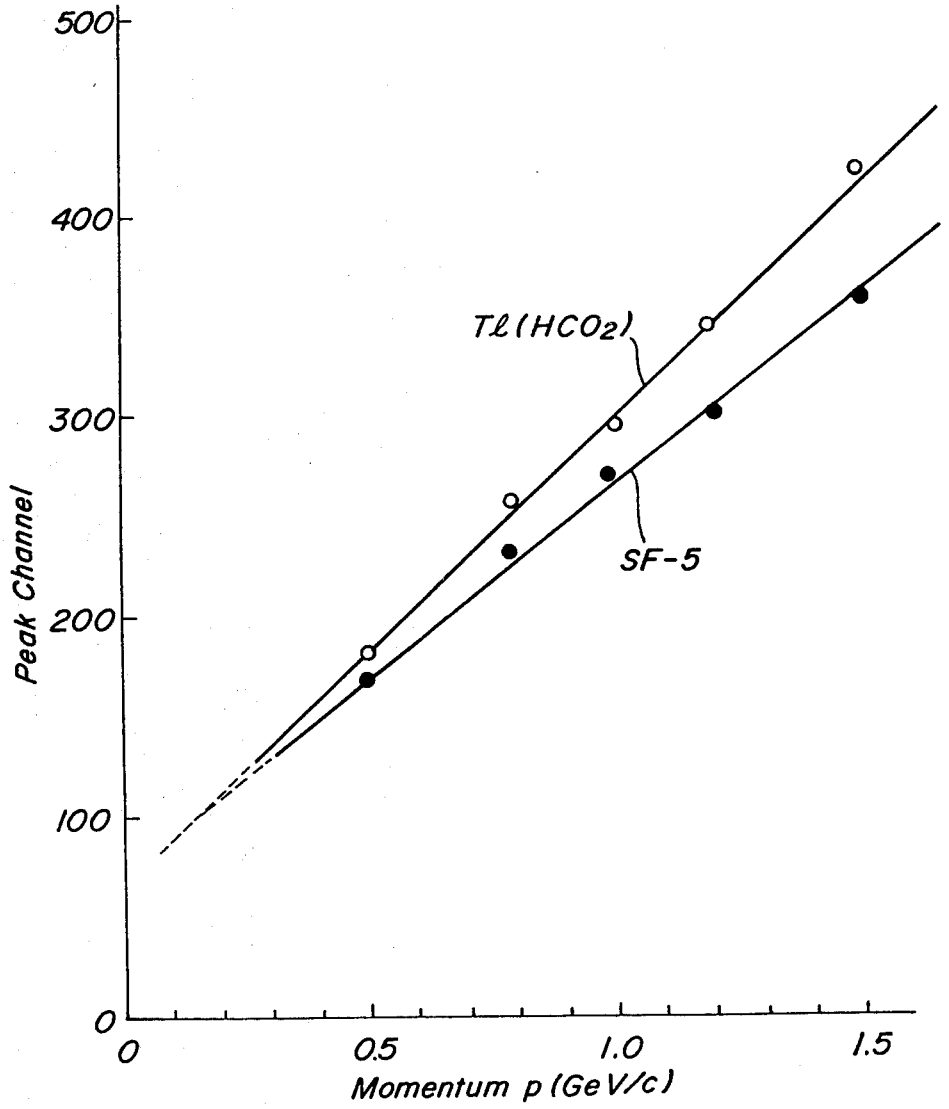
FIG. 4 is a graph showing peak pulse-heights of signals from a counter using thallium formate solution with a density d of 3.27 g/cm$^3$ for different values of momentum of electrons, in comparison with corresponding values obtained by an SF-5 lead glass counter.

Measurements were taken in the test beam line T1 of the proton synchrotron of National Laboratory for High Energy Physics with electrons tagged by the coincidence of two trigger counters and a Freon 13 gas Cherenkov counter operated at 1.2 atm. The beam was focussed into a $1.5\times1.5$ $cm^2$ area by one of the trigger counters and the coincidence signals opened a linear gate and stretcher. The pulse-height distribution of the signals was recorded by using a 512-channel pulse-height analyzer. The linearity was checked with a precision pulse generator to 1% accuracy. The measurements were taken at 0.5, 0.8, 1.0, 1.2, and 1.5 GeV/c with electrons or pions including muons by using the gas Cherenkov counter in coincidence or in anti-coincidence, respectively. The results of the tests with electrons are shown in FIG. 4 indicating the peak pulse-height and in FIG. 5 indicating the resolution (fwhm), the indications being derived from the pulse-height distributions of the signals from both the aforesaid thallium formate counter and the SF-5 lead glass Cherenkov counter.

The inventors believe that the signals from the thallium formate counter were solely due to Cherenkov light, judging from the observation of the pulse shape. The pulse height from the thallium formate counter was higher by 10 to 15% than that from the SF-5 lead glass Cherenkov counter, whereas the resolution of the former was 13 to 25% wider than that of the latter. The data can be explained qualitatively by the lateral and longitudinal leakages of cascade showers together with the angular divergence of the incident beam.

The cross sectional area of the thallium formate solution in terms of radiation length was about 90% of that of the SF-5 lead glass (2.56 r·l×2.56 r·l), whereas the axial length of the former (15.6 r·l) was longer by 36% than that of the SF-5 lead glass counter. This resulted in a higher longitudinal leakage of 1.5 GeV/c for the SF-5 lead glass counter than that for the thallium formate counter and a higher lateral leakage for the thallium formate counter than that for the SF-5 lead glass counter at 0.5 GeV/c. This was further emphasized by the angular divergence of the beam produced by materials (scintillators, multiwire proportional and drift chambers, equivalent to 0.04 r·l) placed upstream of our defining counter by other experimental groups. This resulted in an energy resolution of 14% for 1 GeV/c electrons in the SF-5 lead glass Cherenkov counter while it is normally 10–12%. This effect was further checked by moving the counter axis with respect to the beam axis, i.e., by off-axis injection at 1.0 GeV/c. A 20 mm displacement reduced the pulse height by 15% and broadened the resolution by a factor of 2.0 to 2.5, indicating a large leakage for both counters.

The self-absorption of emitted light was examined by injecting the beam perpendicular to the counter axis. The variation of pulse height was measured as a function of the distance between the flat end coupled to the photomultiplier and the point of beam injection. From the observed attenuation of pulse height at 1.0 GeV/c, the attenuation length was deduced to be approximately 100 cm. This value corresponds to a transmission of 99.0%/cm on average for the S11 spectral response. This can be compared with the measured transmission of 99.0% at wavelength λ of 400 nm as shown in FIG. 1. The transmission of SF-5 lead glass is also 99.0% at wavelength λ of 400 nm within the accuracy (about 0.3%) of the measurement. Thus, the transmission of the present thallium formate solution is equivalent to that of the SF-5 lead glass counter within our measurement errors in the S11 spectral region.

One remarkable feature of the thallium formate solution is its high resistivity to radiation. A 10 cc sample of the thallium formate solution was sealed in a glass bottle and exposed to the fast-extracted proton beam EP1 at a point about 3 m upstream of the beam dump for a period of one complete machine cycle (more than 240 hours). The 12 GeV proton flux was at least $10^9$ p/cm$^2$/s at this point. Although the glass bottle and a zinc iodide ($ZnI_2$) solution tested at the same place acquired a deep brown colour, no change was observed in the colour of the thallium formate solution. The subsequent transmission measurement verified that no change had taken place within the accuracy of the present spectrophotometer (about 0.3%). Two other samples were placed at different places around the fast-extracted proton beam line. The radiation doses, measured by aluminum (Al) foil activation, were $3\times10^3$, $1.6\times10^4$, and $3.1\times10^6$ rad, the last corresponding to the direct proton beam irradiation. None of the three samples of thallium formate solution showed any change either in colour or in transmission.

This should be compared with an SF-5 lead glass for which the transmission at wavelength λ of 350 nm was reduced to approximately 1% after an exposure to cobalt 60 ($Co^{60}$) gammas of $10^5$ rad. Many organic acids are stable against radiation damage and the inventors believe that the thallium formate possesses such characteristics of stableness. Nevertheless, such high stableness against radiation is a remarkable feature of the thallium formate counter, so that the thallium formate solution is particularly useful in such circumstances where high radiation prohibits the use of lead glass or sodium iodide (NaI).

With the aforesaid test results, the inventors are convinced that the thallium formate counter is equivalent to or even superior to the lead glass Cherenkov counter in some respects, i.e., flexibility in shape or size and high resistivity against radiation. So far, the thallium formate solution proved to be stable for more than four months since the inventors started the present series of tests.

Furthermore, the inventors confirmed by tests that the characteristics of the heavy liquid of thallium formate as to photons could be improved by adding thallium malonate as a scintillator or a suitable wavelength shifter therein. The range of the amount of thallium malonate to be added in the thallium formate solution is broad, i.e., 10 to 90% based on the amount of thallium formate. When a large amount of thallium malonate is added in thallium formate, the density of the heavy liquid increases up to about 4.21 g/cm$^3$. On the other hand, when the amount of thallium malonate added is small the water content in the heavy liquid increases and the density of the heavy liquid decreases down to about 2.5 g/cm$^3$.

Judging from the relationship between the density and the concentration of thallium formate as shown in FIG. 2, a suitable concentration in the present invention is 300 to 670 grams of thallium formate per 100 cubic centimeters of water. When the concentration is less than 300 grams of thallium formate per 100 cubic centimeters of water, the density of the solution becomes less than 2.5 g/cm$^3$ which is too small for producing a suitable heavy liquid. On the other hand, the solubility of thallium formate in water is 670 grams per 100 cubic centimeters of water at room temperature, 20° C., so that it is impossible to dissolve thallium formate in excess of the solubility thereof. Thus, when 300 to 670 grams of thallium formate is dissolved in 100 cubic centimeters of water, the resultant solution has a density of 2.5 to 3.3 g/cm$^3$ and a radiation length of 2.5 to 3.5 cm. When both thallium formate and thallium malonate are dissolved in water, a transparent heavy liquid having a density of 2.5 to 4.3 g/cm$^3$, a radiation length of 3.8 to 1.9 cm, and a transmission of not less than 93%, preferably 95 to 99.5%, for light of 400 nm wavelength can be obtained.

The application of the aqueous solution of thallium formate according to the invention is not restricted to calorimeters, i.e. counters. For instance, the aqueous solution of thallium formate can be used in a radiation-shielding window where lead glass is currently used and zinc bromide was used in the past.

Figure 6:
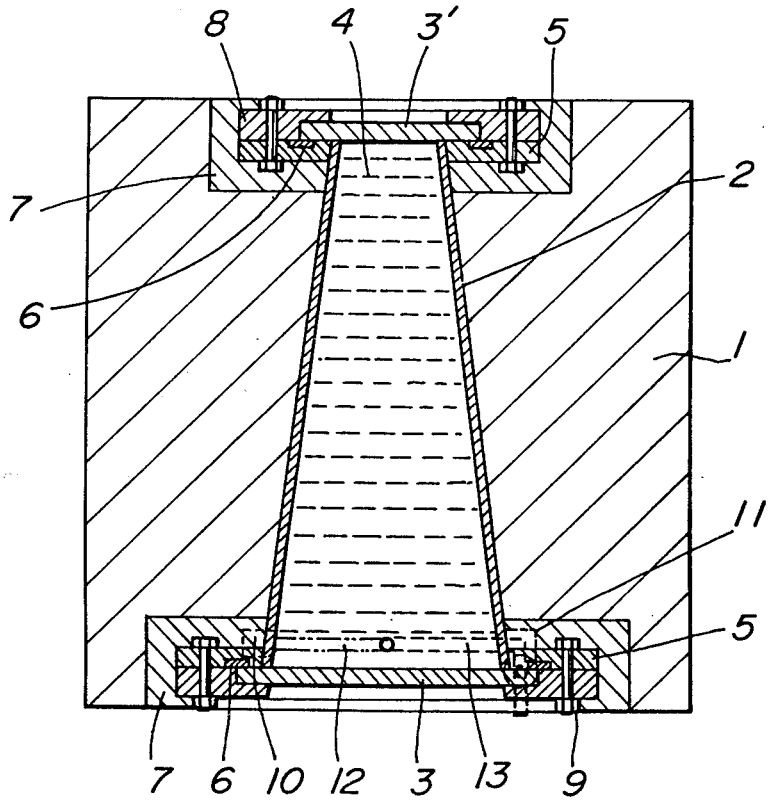
FIGS. 6 and 7 are a sectional view and a plan view of a radiation-shielding concrete block, which shielding block has a window using a heavy liquid of thallium formate according to the present invention.
Figure 7:
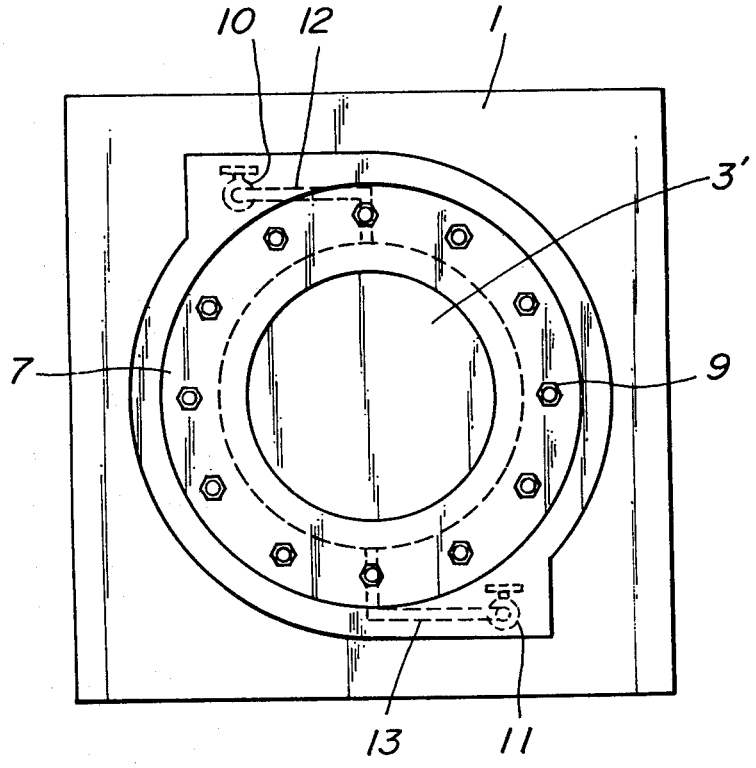

FIG. 6 and FIG. 7 show a sectional view and a plan view of a radiation-shielding block having a window filled with the transparent thallium formate heavy liquid of the present invention. Referring to the figures, concrete shielding block 1 has a stainless steel casing 2 of tapered cylindrical shape embedded therein, and shielding glass plates 3 and 3' are airtightly fitted at the opposite ends of the stainless steel casing 2. According to the invention, the stainless steel casing 2 is airtightly filled with the heavy liquid 4 of thallium formate solution, which heavy liquid is prepared by dissolving thallium formate in distilled water while deoxidizing them or by further dissolving thallium malonate therein. Thus, the opposite ends of the stainless steel casing 2 are airtightly sealed. The sheilding glass plates 3 and 3' are held by flanges 5 of the stainless steel casing 2, and three-way sealing gaskets 6 made of, for instance, Teflon ®, act to airtightly seal the joints of the shielding glass plates 3 and 3' with both the flange 5 and the window hollow flange 8. Bolts and nuts 9 fasten the window-holder flanges 7 and 8. Valves 10 and 11 regulate flow of the heavy liquid through pipes 12 and 13.

The formation and function of the concrete shielding block 1 with a transparent window containing the aqueous solution of thallium formate according to the invention will be described now in further detail.

The shielding block 1 of the illustrated embodiment is of cubic shape and its outside dimension is, for instance, 1 m×1 m×1 m. The material of the shielding block 1 is, for instance, heavy concrete or light concrete, so that the block 1 can form a part of a shielding wall surrounding a radiation source (not shown). The stainless steel casing 2 of tapered cylindrical shape is airtightly secured to the central portion of the shielding block 1 so as to extend therethrough, and the shielding glass plate 3, or a window glass, of 40 cm diameter is airtightly secured to the inner surface (the surface facing an area of high intensity radiation) of the casing 2, while the other shielding glass plate 3', or another window glass, of 20 cm diameter is airtightly secured to the outer surface (the surface facing an area of low intensity radiation) of the casing 2.

A heavy liquid of thallium formate of the invention, which for instance has a density of 3.2 g/cm$^3$, a radiation length of 2.6 cm, and a transmision of 99.0% for light of 400 nm wavelength, is poured into the stainless steel casing 2 through the valve 10 and the pipe 12 disposed on the inner upper side of the block 1, so as to fill up the inside space of the casing 2. The shielding ability of the heavy liquid thus filling the casing 2 is equivalent to or superior to those of the heavy concrete and the light concrete in terms of the shielding of $\gamma$-ray and neutron beams.

Accordingly, it is possible to directly see the inside area of the shielding block 1 from the outside of the block 1, so that the block 1 can be used to form a check window on a shielding wall surrounding a radiation source such as a nuclear reactor or other radiation apparatus. When the heavy liquid 4 with the aforesaid transmission of 93 to 99.5% has a thickness of 90 cm, about 40% of the incident light at the inner surface is transmitted to the outside of the outer surface thereof. From the standpoint of the direct inspection by human eyes, the aforesaid loss of light in the heavy liquid 4 in the casing 2 will not cause any difficulty.

Although lead glass is currently used in a checking window provided through a shielding wall, lead glass has restrictions on shape and size due to the solid state thereof. Besides, lead glass is mechanically weak, and a shielding window made of lead glass is susceptible to breakage when being used, which breakage is often very difficult to repair.

Aqueous solution of zinc bromide ($ZnBr_2$) were used 20 to 30 years ago in radiation-shielding checking windows, and such solutions are used only in exceptional cases at the present. The reason for the retreat from use of a zinc bromide solution is in the shortcomings thereof; namely, its density is 2.5 g/cm$^3$ and low, its radiation length is more than 5.0 cm and not short enough, its transmission is low (several months' use causes colour change into yellowish brown), and it is chemically unstable and corrosive to many metals.

On the other hand, the thallium formate heavy liquid developed by the inventors for experiments of high-energy physics has excellent properties as pointed out above, for instance, a density of 3.2 g/cm$^3$, a radiation length of 2.6 cm, a transmission of 93 to 99.5% for light of 400 nm wavelength, and radiation shielding ability more than twice that of zinc bromide ($ZnBr_2$) solution. Besides, the heavy liquid of the invention is transparent without any colour and chemically stable, and has a high resistivity against radiation damage (no change after irradiation of $3\times10^6$ rad) in excess of one thousand times that of lead glass. Tests of more than two months confirmed that the heavy liquid of the invention is mutually stable with stainless steel, aluminum, Teflon ®, and acrylite.

The shielding block 1 of FIGS. 6 and 7 can be constructed as follows. The stainless steel casing 2 of tapered cylindrical shape has inner and outer flanges 5 integrally secured thereto, and the casing 2 is joined to the concrete of the shielding block 1 when the concrete is poured. Both the stainless steel casing 2 and the flanges 5 integrally secured thereto must have sufficient mechanical strength to hold the heavy liquid with a density of 3.3 g/cm$^3$ or more, and such casing 2 and flanges 5 must be free from any leakage of the heavy liquid 4.

Similarly, the glass plates 3 and 3', preferably made of tempered glass (e.g., for marine use), must have sufficient mechanical strength to hold the heavy liquid 4 with a density of 3.3 g/cm$^3$ or more. Such glass plates 3 and 3' are secured to the inner and outer ends of the stainless steel casing 2 by means of the window-holder flanges 7 and 8 and fastened thereto by bolts and nuts 9.

Airtightness is ensured by inserting the three-way sealing gaskets 6, preferably made of Teflon ®, between the glass plates 3 and 3' and the flanges 5 in such a manner that the sealing gaskets 6 also engage the window-holder flanges 8.

The thallium formate heavy liquid 4 is poured into the inside of the stainless steel casing 2 from an outside container (not shown) through the pipe 12 at the upper inside portion of the block 1 (upper left-hand side of FIG. 7) while regulating the flow of the heavy liquid 4 by operating the valve 10 mounted on the pipe 12. To discharge the heavy liquid 4, the valve 11 mounted on the pipe 13 at the lower inside portion of the block 1 (lower right-hand side of FIG. 7) is operated so as to allow the heavy liquid 4 to flow from the stainless steel casing 2 to the aforesaid outside container.

Preferably, rectangular portions are provided on the concrete shielding block 1 in the proximities of the valves 10 and 11 as shown in FIG. 7, so as to facilitate the operation of the valves 10 and 11.

The entire structure of the shielding block 1 of FIGS. 6 and 7 should have sufficient mechanical strength to hold the thallium formate heavy liquid with a density of 3.3 g/cm$^3$ or more without allowing any leakage, and the shielding block 1 should be constructed so as to shield and confine radiation within the area surrounded thereby.

When the concrete shielding block 1 is used both in the summer and in the winter without any temperature control, suitable cylindrical buffers of proper volume (for instance, with a volume of about 50 cubic centimeters and allowing inspection of liquid level therein from the outside) can be disposed between the pipe 12 or 13 and the valve 10 or 11 and between the pipe 12 or 13 and the stainless steel casing 2, because the heavy liquid 4 has a coefficient of volume expansion of about $0.6\times10^{-3}$.

When the concrete shielding block 1 is used at a very high or very low ambient temperature, a suitable cooling or heating system may be used together with a liquid circulating system having a small pump connected to the pipes 12 and 13 for recirculating the heavy liquid 4.

It should be noted that although FIGS. 6 and 7 show the concrete shielding block 1 having a checking window integrally formed therewith, similar checking window can be built in the shielding wall surrounding a radiation source such as a nuclear reactor during construction of such wall.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. Radiation-shielding transparent material consisting of an aqueous solution of deoxidized thallium formate dissolved in deoxidized distilled water, said material having a density of 2.5 to 3.3 g/cm$^3$, a radiation length of 3.8 to 1.9 cm, and a transmission of not less than 93% for light of 400 nm wavelength.

2. Radiation-shielding transparent material as set forth in claim 1, wherein said material consists of 300 to 670 grams of thallium formate per 100 cubic centimeters of water.

3. Radiation-shielding transparent material consisting of an aqueous solution of deoxidized thallium formate and deoxidized thallium malonate dissolved in deoxidized distilled water, said material having a density of 2.5 to 4.3 g/cm$^3$, a radiation length of 3.8 to 1.9 cm, and a transmission of not less than 93% for light of 400 nm wavelength.

4. Radiation-shielding transparent material as set forth in claim 3, wherein said material consists of 300 to 800 grams of thallium formate and thallium malonate per 100 cubic centimeters of water.

5. A method of producing radiation-shielding transparent material, comprising separately deoxidizing thallium formate and distilled water, and dissolving the thus deoxidized thallium formate in the deoxidized distilled water in a non-oxidizing atmosphere at a rate of 300 to 670 grams of thallium formate per 100 cubic centimeters of water, so as to produce radiation-shielding transparent materials having a density of 2.5 to 3.3 g/cm$^3$, a radiation length of 3.8 to 2.6 cm, and a transmission of not less than 93% for light of 400 nm wavelength.

6. A method of producing radiation-shielding transparent material, comprising separately deoxidizing thallium formate, thallium malonate, and distilled water, mixing 10 to 90% of the deoxidized thallium malonate based on the amount of thallium formate into the deoxidized thallium formate, and dissolving 300 to 800 grams of the mixture thus prepared into 100 cubic centimeters of the deoxidized water, so as to produce radiation-shielding transparent material having a density of 2.5 to 4.3 g/cm$^3$, a radiation length of 3.8 to 1.9 cm, land a transmission of not less than 93% for light of 400 nm wavelength.

7. A window through a radiation-shielding wall surrounding a radiation source, comprising a hollow tubular casing airtightly embedded in said wall so as to extend across opposite surfaces of said wall through a thickness thereof, two glass plates airtightly secured to opposite end openings of said hollow tubular casing, and an aqueous heavy solution of thallium formate filling a hollow inside space of said tubular casing with opposite ends thereof closed by said glass plates, said aqueous heavy solution having a density of 2.5 to 4.3 g/cm$^3$, a radiation length of 3.8 to 1.9 cm, and a transmission of not less than 93% for light of 400 nm wavelength.

8. A window as set forth in claim 7, wherein said aqueous heavy solution further contains thallium malonate.

9. A shielding block, comprising a concrete block forming a substantial portion of said shielding block, a hollow tubular casing airtightly embedded in said concrete block so as to extend across opposite surfaces of said concrete block through a thickness thereof, said concrete block solidly filling up the entire inside space of said shielding block except said hollow tubular casing, two glass plates airtightly secured to opposite end openings of said hollow tubular casing, and an aqueous heavy solution of thallium formate filling a hollow inside space of said tubular casing with opposite ends thereof closed by said glass plates, said aqueous heavy solution having a density of 2.5 to 4.3 g/cm$^3$, a radiation length of 3.8 to 1.9 cm, and a transmission of not less than 93% for light of 400 nm wavelength.

10. A shielding block as set forth in claim 9, wherein said aqueous heavy solution further contains thallium malonate.

* * * * *